US008490754B2

(12) United States Patent
Amano

(10) Patent No.: US 8,490,754 B2
(45) Date of Patent: Jul. 23, 2013

(54) ELEVATOR CONTROL DEVICE INTERFACING WITH A SECURITY GATE SYSTEM

(75) Inventor: Masaaki Amano, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 354 days.

(21) Appl. No.: 12/992,977

(22) PCT Filed: Aug. 26, 2008

(86) PCT No.: PCT/JP2008/065193

§ 371 (c)(1),
(2), (4) Date: Nov. 16, 2010

(87) PCT Pub. No.: WO2010/023723

PCT Pub. Date: Mar. 4, 2010

(65) Prior Publication Data

US 2011/0127117 A1 Jun. 2, 2011

(51) Int. Cl.
*B66B 1/20* (2006.01)

(52) U.S. Cl.
USPC ..... 187/384; 187/392

(58) Field of Classification Search
USPC ..... 187/247, 380–388, 391–393, 395, 187/396
See application file for complete search history.

(56) References Cited

U.S. PATENT DOCUMENTS 4,979,594 A * 12/1990 Begle et al. ..... 187/380
6,397,976 B1 * 6/2002 Hale et al. ..... 187/392
6,707,374 B1 * 3/2004 Zaharia ..... 340/5.31
7,190,256 B2 * 3/2007 Pieper ..... 340/5.7
7,328,775 B2 * 2/2008 Zaharia et al. ..... 187/396
7,353,915 B2 * 4/2008 Zaharia et al. ..... 187/388
7,500,544 B2 * 3/2009 Hakala et al. ..... 187/382

(Continued)

FOREIGN PATENT DOCUMENTS

JP 05 058564 3/1993
JP 2003 104633 4/2003

(Continued)

OTHER PUBLICATIONS

International Search Report issued Apr. 7, 2009 in PCT/JP08/065193 filed Aug. 26, 2008.

(Continued)

*Primary Examiner* — Anthony Salata
(74) *Attorney, Agent, or Firm* — Oblon, Spivak, McClelland, Maier & Neustadt, L.L.P.

(57) ABSTRACT

In an elevator control device in which, when a verified person is authenticated as a registered person by an person authentication device, a security gate is opened to enable the movement into an elevator hall, even when a user cannot ride on an assigned car for some reason after passing through the security gate, the user is enabled to use an elevator. For this purpose, a hall destination floor registration device is provided in the elevator hall so that the user who is present in the hall registers his/her destination floor. A destination call is always registered automatically interlocking with the security gate, and when a predetermined condition is met, the destination floor registration of user made using the hall destination floor registration device is validated.

4 Claims, 5 Drawing Sheets

U.S. PATENT DOCUMENTS

| | | | | |
|---|---|---|---|---|
| 7,581,622 | B2 * | 9/2009 | Amano | 187/384 |
| 7,849,974 | B2 * | 12/2010 | Stanley et al. | 187/387 |
| 7,936,249 | B2 * | 5/2011 | Friedli | 340/5.5 |
| 8,028,806 | B2 * | 10/2011 | Stanley et al. | 187/387 |
| 8,061,485 | B2 * | 11/2011 | Finschi | 187/384 |
| 2009/0020372 | A1 * | 1/2009 | Amano | 187/384 |
| 2011/0168498 | A1 * | 7/2011 | Amano | 187/384 |
| 2012/0097486 | A1 * | 4/2012 | Suzuki et al. | 187/384 |
| 2012/0138389 | A1 * | 6/2012 | Furutani | 187/247 |
| 2012/0145488 | A1 * | 6/2012 | Nakashima | 187/389 |
| 2012/0175195 | A1 * | 7/2012 | Koba | 187/382 |
| 2012/0193173 | A1 * | 8/2012 | Wu | 187/384 |
| 2013/0068568 | A1 * | 3/2013 | Nonami | 187/381 |

FOREIGN PATENT DOCUMENTS

| | | | |
|---|---|---|---|
| JP | 2004 75361 | | 3/2004 |
| JP | 2005-247439 | A | 9/2005 |
| JP | 2006-151540 | A | 6/2006 |
| JP | 2007 169030 | | 7/2007 |
| JP | 2007 246257 | | 9/2007 |
| JP | 2007 320758 | | 12/2007 |
| WO | 2006 043324 | | 4/2006 |

OTHER PUBLICATIONS

Office Action issued on Feb. 5, 2013, in Japanese patent Application No. 2010-526445 with partial English translation.

* cited by examiner

ELEVATOR CONTROL DEVICE INTERFACING WITH A SECURITY GATE SYSTEM

TECHNICAL FIELD

The present invention relates to an elevator control device which interfaces with a building security gate system.

BACKGROUND ART

In recent years, many buildings have been provided with a security gate at the entrance for the purposes of crime prevention in the building and entry prevention of suspicious persons. In such buildings, a system has been introduced in which a predetermined authentication device (for example, a non-contact card reader or a biometric authentication device such as a fingerprint authentication device) is provided at the security gate, whereby entry into an elevator hall is first allowed via the authentication using this authentication device. Basically, the above-described system is often provided to increase the security of building.

Regarding the elevator control device which is provided in the building and interfaces with the building security gate system, some proposals have been made so far.

For example, Patent Document 1 proposes a technique in which when a person coming to the gate is judged to be a resident of the building, the gate is opened, and at the same time, an elevator is called to the entrance floor on which the gate is provided. Also, Patent Document 2 proposes a technique in which the destination floor information of a user is read by a reader provided at the security gate, and the user is guided to the assigned elevator No. by using a guiding device in an elevator hall. Further, Patent Document 3 proposes a technique in which in the case where the security gate is provided throughout a plurality of banks, the user is allocated to a proper bank based on the information authenticated at the security gate, and the destination call is automatically registered after the user has ridden on the elevator car.

Patent Document 1: Japanese Patent Laid-Open No. 2004-75361

Patent Document 2: Japanese Patent Laid-Open No. 2007-320758

Patent Document 3: International Publication WO2006/043324

DISCLOSURE OF THE INVENTION

Problems to be Solved by the Invention

Patent Documents 1 to 3 disclose elevator control devices which interface with a security gate. However, the elevator control devices described in Patent Documents 1 to 3 cannot respond to the problems and events described below.

A. The background art does not describe a method for taking measures when a person passing through the security gate cannot ride on a car assigned to him/her. As the case where the user cannot ride on the assigned car, there can be cited, for example, the case where the user fails to catch the car, the case where the assigned car is full-load, and the case where the user cannot ride on the assigned car due to the occurrence of some failure of the assigned car.

B. The background art does not describe a method for assigning destination call according to moving time from when the user passes through the security gate to when he/she arrives at the elevator hall or the moving distance.

The present invention has been made to solve the above-described problems, and the object of the invention is to provide an elevator control device that enables a user to use an elevator even when the user cannot ride on the assigned car for some reason after passing through a security gate, and is capable of preventing convenience from becoming poor.

Another object of the present invention is to carry out, in the above-described elevator control device, optimum operation control considering the distance from the security gate to an elevator hall and the moving time of the user.

Means for Solving the Problems

An elevator control device according to an embodiment of the present invention includes a group control cabinet for controlling a plurality of elevators provided in a building as one group, a security gate provided on a passage leading to a hall of the one group of elevators, and a person authentication device provided at the security gate, and wherein when a verified person is authenticated as a registered person by the person authentication device, the security gate is opened to allow the verified person to move into the hall. The elevator control device further includes a destination call assignment device provided in the group control cabinet to determine an assigned car for the verified person, who has been authenticated, based on the previously registered destination floor information when the verified person is authenticated as the registered person by the person authentication device, a destination call automatic registration device which automatically registers the destination call based on the destination floor information for the assigned car when it is detected that a user has boarded the assigned car, which is determined by the destination call assignment means, at a predetermined floor, a hall destination floor registration device provided in the hall so that the user who is present in the hall registers his/her destination floor, and a registration controller which validates the destination floor registration of the user made using the hall destination floor registration device based on a predetermined condition.

Effect of the Invention

According to the present invention, even when a user cannot ride on the assigned car for some reason after passing through a building security gate, the user is enabled to use an elevator, and convenience can be prevented from becoming poor.

Furthermore, optimum operation control considering the distance from the security gate to the elevator hall or the moving time of the user can be realized.

BRIEF OF DESCRIPTION OF THE DRAWINGS

DESCRIPTION OF SYMBOLS

1 group control cabinet, 2 security gate,
3 person authentication device, 4 indication device,
5 verification control device, 6 database,
7 verification processing means, 8 control panel,
9 control panel, 10 operation control means,
11 ride-on detection means, 12 communication means,
13 car, 14 elevator No. indication board,
15 operation control means, 16 ride-on detection means,
17 communication means, 18 car,
19 elevator No. indication board,
20 hall destination floor registration device,
21 destination call assignment means,
22 communication means, 23 hall call registration means,
24 destination call automatic registration means,
25 registration control means, 26 operation control means,
27 person authentication device,
28 destination floor input section, 29 indication section

BEST MODE FOR CARRYING OUT THE INVENTION

The present invention will be described in more detail with reference to the accompanying drawings. Incidentally, in each of the drawings, like numerals refer to like or similar parts and redundant descriptions of these parts are appropriately simplified or omitted.

First Embodiment

Figure 1:
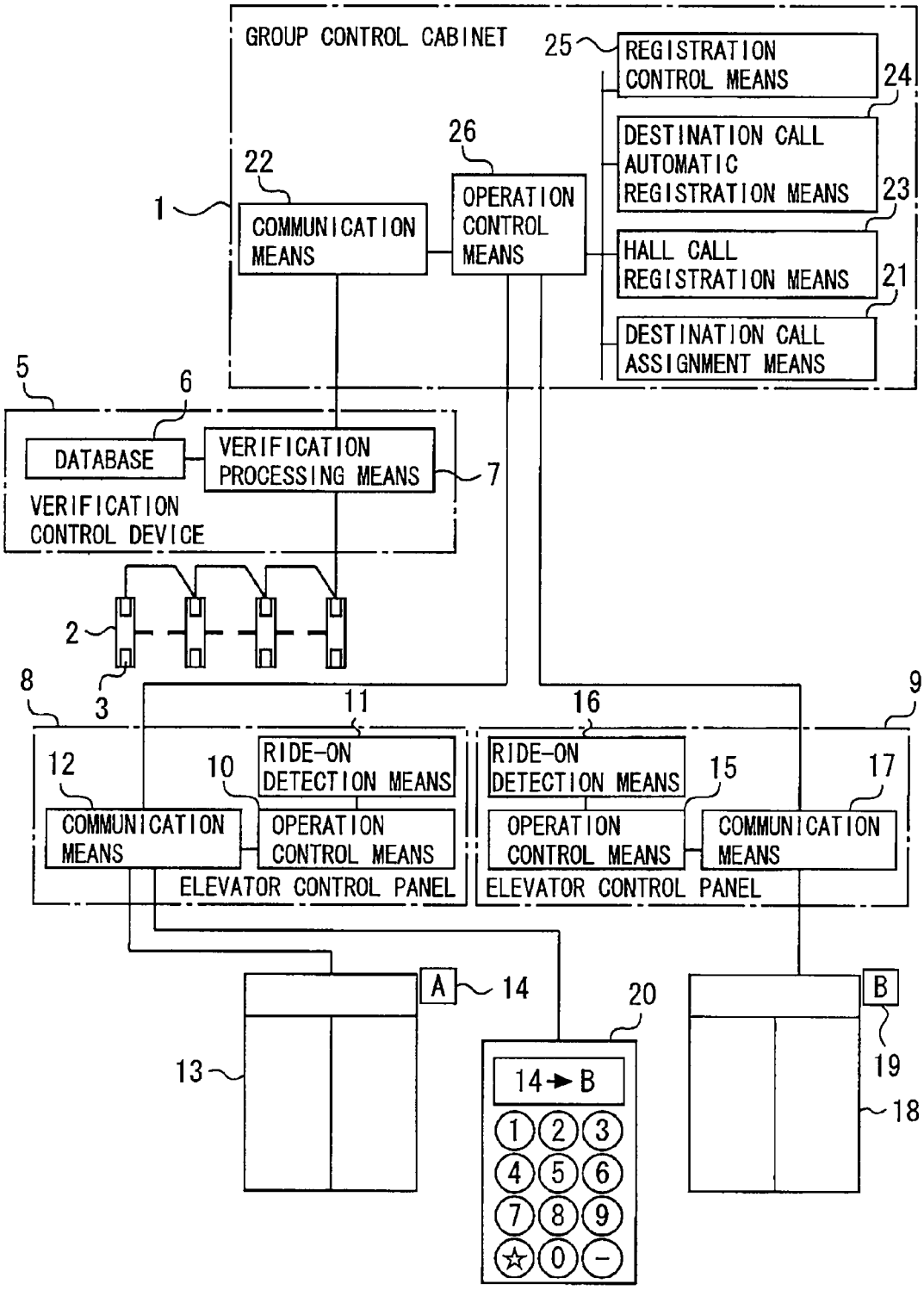
FIG. 1 is a block diagram showing a configuration of an elevator control device in a first embodiment according to the present invention.

FIG. 1 is a block diagram showing a configuration of an elevator control device in a first embodiment according to the present invention. In FIG. 1, symbol 1 denotes a group control cabinet for controlling a plurality of elevators provided in a building as one group. One group of elevators controlled by the group control cabinet 1 may be all of the elevators provided in the building or may be some thereof.

Symbol 2 denotes a security gate provided on a passage leading to a hall of the above-described one group of elevators. The security gate 2 is provided for the purposes of crime prevention in the building and entry prevention of a suspicious person, and is installed, for example, on the entrance floor of the building. Specifically, in the case where the group control cabinet 1 controls all of the elevators provided in the building, the security gate 2 is installed at the entrance or the like of the building. Also, in the case where an unspecified large number of persons are permitted to enter one part of the building and only specified persons are permitted to enter the other part of the building, the security gate 2 is installed on a passage or the like leading from the one part to the other part of the building, and is arranged so that unless the person passes through the security gate 2, he/she cannot ride on an elevator leading to the other part of the building.

The security gate 2 is provided with a person authentication device 3 and an indication device 4 (not shown in FIG. 1).

The person authentication device 3 is configured by, for example, a non-contact card reader or a biometric authentication device such as a fingerprint or vein pattern authentication device. The person authentication device 3 judges, based on the inputted verification information (for example, the information read by the card reader, or the biometric information such as fingerprint or vein pattern), whether or not the verified person is a person registered previously (hereinafter, referred to as a "registered person"). When authenticating that the verified person is a registered person by the collation judgment of the inputted verification information with the verified information stored previously, the person authentication device 3 opens the corresponding security gate 2 so that the verified person can move into the elevator hall.

The indication device 4 has the function of providing information to a verified person who is using the person authentication device 3.

A verification control device 5 has the function of relating the security gate 2 to the operation of the elevator controlled by the group control cabinet 1. Specifically, the essential portion of the verification control device 5 is configured by a database 6 and a verification processing means 7. The database 6 stores the verified information of the person who is permitted to pass through the security gate 2 (that is, the registered person) and the destination floor information of that person in a related form. When the person authentication device 3 authenticates that the verified person is the registered person, the verification processing means 7 extracts the destination floor information of the verified person from the database 6, and transmits it to the group control cabinet 1.

Symbols 8 and 9 are control panels for controlling the elevators controlled by the group control cabinet 1. FIG. 1 shows, as the simplest example, the case where two elevators of elevator A and elevator B are controlled by the group control cabinet 1.

The essential portion of the control panel 8 for elevator A is configured by an operation control means 10, a ride-on detection means 11, and a communication means 12.

The operation control means 10 carries out operation control of the whole of elevator A including the control of a car 13 of elevator A. The ride-on detection means 11 has the function of detecting that the user has ridden on the car 13 and has gotten off the car 13. The ride-on detection means 11 detects the riding on and getting off of the user based on a detection signal sent from, for example, a load weighing device for detecting the load of the car 13 or a non-contact door sensor. The communication means 12 has the function of providing communication between the group control cabinet 1, the control panel 8, the car 13, and hall equipment.

Symbol 14 denotes an elevator No. indication board provided in the hall of elevator A. The elevator No. indication board 14, which indicates the elevator No., is installed near the entrance of elevator A. The elevator No. indication board 14 may be configured simply as a nameplate, or may be configured so as to be used as both a nameplate and a hall lantern.

Elevator B has the same configuration as that of elevator A. The control panel 9 of elevator B includes an operation control means 15, a ride-on detection means 16, and a communication means 17, which means have the same respective functions as those of the means 10 to 12. Symbol 18 denotes a car of elevator B. In the hall of elevator B, an elevator No. indication board 19 is provided.

Symbol 20 denotes a hall destination floor registration device provided in the elevator hall. The hall destination floor registration device 20 has the function of allowing the user who is present in the hall to register his/her destination floor. Between the hall destination floor registration device 20 and the group control cabinet 1, information is transmitted and received via the communication means 12. The hall destination floor registration device 20 may be provided only on the floor on which the security gate 2 is provided, or may be provided on all or some floors at which elevator A and elevator B stop.

Next, the function and configuration of the group control cabinet 1 are specifically explained.

The essential portion of the group control cabinet 1 is configured by, for example, a destination call assignment means 21, a communication means 22, a hall call registration means 23, a destination call automatic registration means 24, a registration control means 25, and an operation control means 26.

The destination call assignment means 21 has the function of assigning the destination call to the optimum elevator (the car 13 of elevator A or the car 18 of elevator B in the configuration shown in FIG. 1) among the controlled elevators when the elevator user has registered the destination floor.

As methods for allowing the elevator user to register the destination floor, there are available a method in which registration is made via the passage of the security gate 2, and a method in which registration is made by operating the hall destination floor registration device 20. The destination call assignment means 21 corresponds to both the above-described registration methods. For example, when the verified person is authenticated as the registered person by the person authentication device 3, and the destination floor information of the verified person, which is stored in advance, is transmitted from the verification control device 5 to the group control cabinet 1, the destination call assignment means 21 selects the car assigned to the verified person based on the received destination floor information. Also, when the destination floor registration is made effectively from the hall destination floor registration device 20, the destination call assignment means 21 selects the car assigned to the operator based on the destination floor information of the operator, which is transmitted from the hall destination floor registration device 20.

The communication between the group control cabinet 1 and the verification control means 5 is controlled by the communication means 22. Therefore, the destination floor information sent from the verification control means 5 is received by the group control cabinet 1 via the communication means 22. Also, when the car assigned to the verified person is determined by the destination call assignment means 21, the information on the assigned car is transmitted to the verification control means 5 via the communication means 22, and is displayed on the corresponding indication device 4 together with the destination floor information of the verified person.

The hall call registration means 23 has the function of registering the hall call for the assigned car when the assigned car is determined by the destination call assignment means 21. For example, in the case where the assigned car is selected based on the destination floor information sent from the verification control device 5, the hall call registration means 23 registers, for the assigned car, the hall call of the floor on which the security gate 2 is provided. Also, in the case where the assigned car is selected based on the destination floor information sent from the hall destination floor registration device 20, the hall call registration means 23 registers, for the assigned car, the hall call of the floor on which the hall destination floor registration device 20 by which the destination floor registration has been made is provided.

The destination call automatic registration means 24 has the function of automatically registering the destination call at proper timing for the assigned car after the assigned car has been determined by the destination call assignment means 21. For example, in the case where the assigned car is selected based on the destination floor information sent from the verification control device 5, when it is detected that the user has ridden on the assigned car at a predetermined floor, the destination call automatic registration means 24 automatically registers the destination call based on the destination floor information for the assigned car.

The predetermined floor means a floor at which the verified person having passed through the security gate 2 rides on the assigned car, and generally corresponds to the floor on which the security gate 2 is installed. Also, in the case where the car 13 of elevator A is selected as the assigned car, the detection of the fact that the user has ridden on the assigned car at the predetermined floor is made based on, for example, the information inputted from the control panel 8 (the stop floor information of car 13 given by the operation control means 10, the detection information given by the ride-on detection means 11, or the like).

Also, in the case where the assigned car is selected based on the destination floor information sent from the hall destination floor registration device 20, when it is detected that the user has ridden on the assigned car at the floor on which the hall destination floor registration device 20 is installed and destination floor registration has been made, the destination call automatic registration means 24 automatically registers the destination call based on the destination floor information for the assigned car.

The registration control means 25 has the function of judging, based on a predetermined condition, whether or not the destination floor registration of the user made using the hall destination floor registration device 20 is valid. If the predetermined condition is not met, the registration control means 25 invalidates the destination floor registration made using the hall destination floor registration device 20, and carries out control so that even if the user inputs his/her destination floor using the hall destination floor registration device 20, the registration of hall call using the hall call registration means 23 and the registration of destination call using the destination call automatic registration means 24 are not made.

The operation control means 26 carries out operation control of the whole of elevator properly based on the information and the like given from the above-described means 21 to 25.

Figure 2:
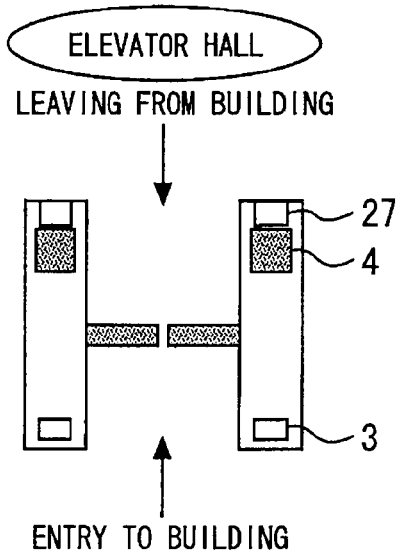
FIG. 2 is a plan view showing a configuration of the security gate.
Figure 3:
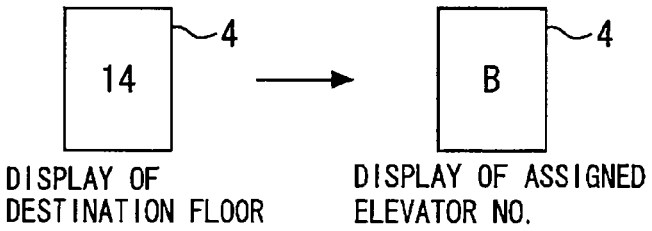
FIG. 3 is a view showing a display example of the indication device.
Figure 4:
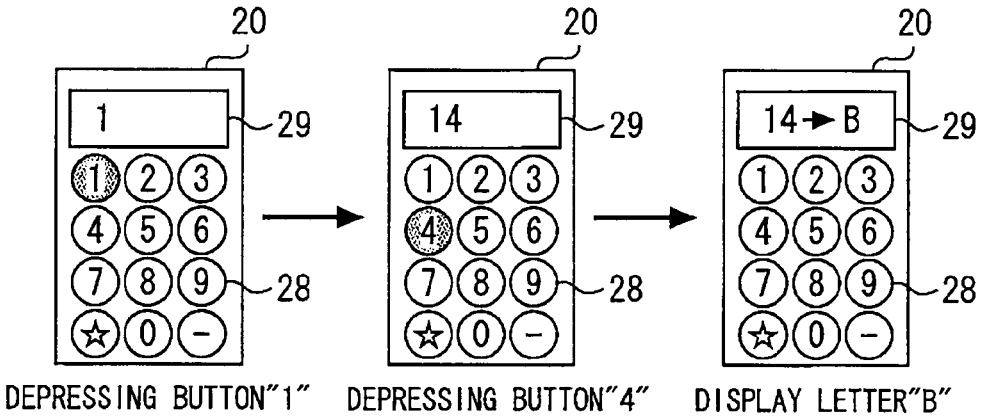
FIG. 4 is a view showing an operation example of the hall destination floor registration device.

Next, specific examples of the security gate 2 and the hall destination floor registration device 20 are explained with reference to FIGS. 2 to 4. FIG. 2 is a plan view showing a configuration of the security gate, FIG. 3 is a view showing a display example of the indication device, and FIG. 4 is a view showing an operation example of the hall destination floor registration device.

For the security gate 2, as shown in FIG. 2, for example, the person authentication device 3 is installed in the end part on the entrance side at the time of entry to the building, and an person authentication device 27 having the same configuration as that of the person authentication device 3 is installed in the end part on the entrance side at the time of leaving from the building. The indication device 4 is provided near the person authentication device 27, and is arranged so that the verified person having been authenticated as the registered person by the person authentication device 3 can easily see displayed his/her destination floor information and assigned car. When the verified person is authenticated as the registered person by the person authentication device 3, on the indication device 4, first, the destination floor stored previously for the verified person (for example, 14 indicating 14th floor) is displayed, and thereafter the assigned car (B indicating elevator B) is displayed as shown in FIG. 3.

The hall destination floor registration device 20 is configured by, for example, a destination floor input section 28 in the lower part and an indication section 29 in the upper part.

The destination floor input section 28 is used so that the user present in the hall inputs the destination floor. The indication section 29 is used to display information necessary for the user, and displays the inputted destination floor, the information on the assigned car, and the like. FIG. 4 shows a display in the case where the user inputs the destination floor so as to be 14th floor, and elevator B is selected as the assigned car. That is, the user first inputs his/her destination floor by successively depressing button "1" and button "4" in the destination floor input section 28. When the destination floor is determined to be 14th floor, and elevator B is assigned, a letter B indicating elevator B is displayed in the indication section 29.

FIGS. 1 and 4 show, as one example, the case where the destination floor input section 28 is of a numerical keypad type. However, the type of the hall destination floor registration device 20 is not subject to any special restriction, and may be a touch panel type, for example. Also, another person authentication device (not shown) is installed in the hall, and thereby the hall destination floor registration device 20 may be configured by being combined with this person authentication device. In this case, the registration control means 25 always invalidates the destination floor registration of the user made using the hall destination floor registration device 20, for example. Then, in the case where the verified person is authenticated as the registered person by the person authentication device installed in the hall, the registration control means 25 validates the destination floor registration of the user made using the hall destination floor registration device 20. In this case, by configuring the person authentication device installed in the hall by the same type as that of the person authentication device 3, the registration data can be made common, and the convenience of user can be improved.

Next, the operation of the elevator control device configured as described above is explained with reference to FIGS. 5 to 7.

Figure 5:
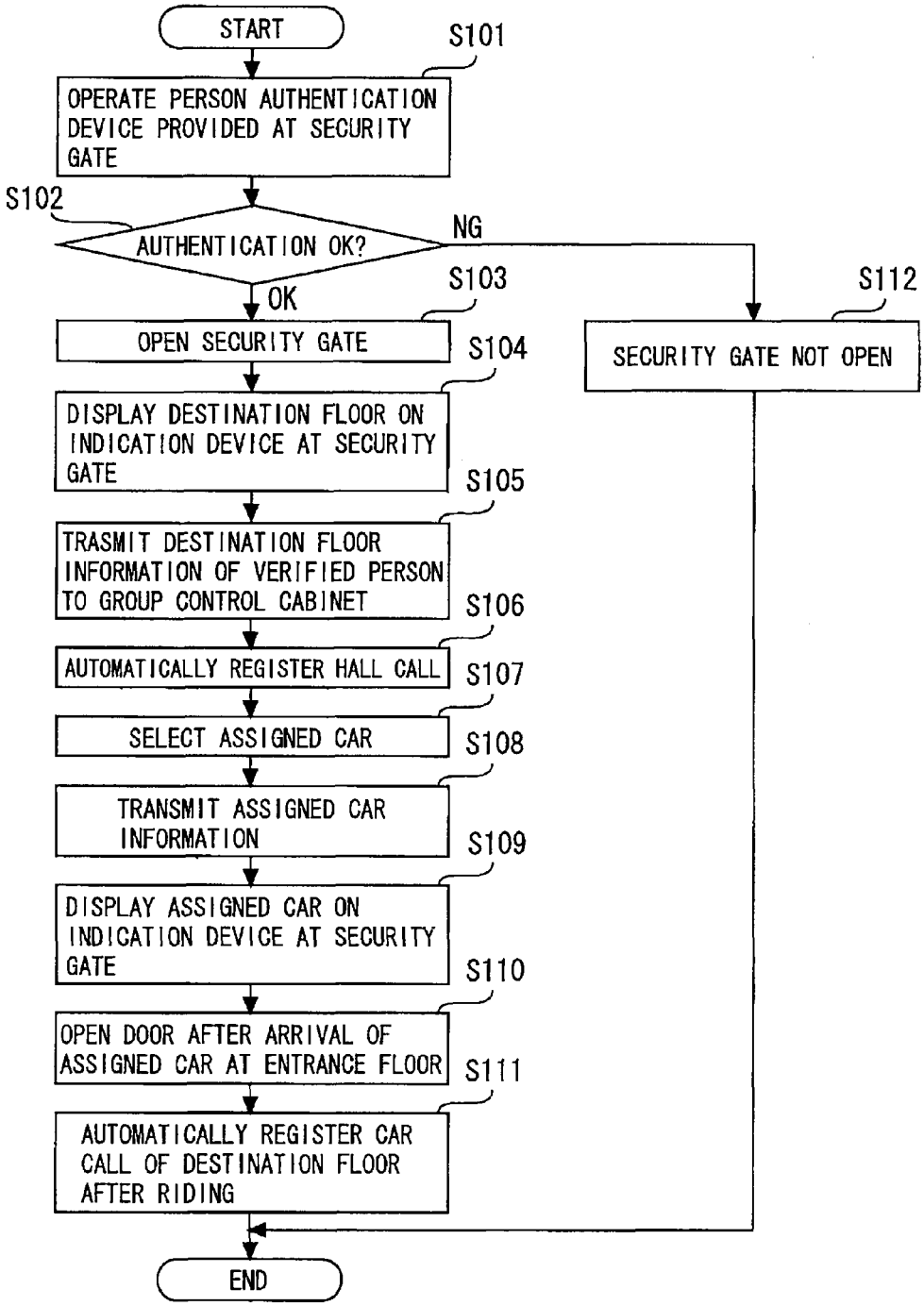
FIG. 5 is a flowchart showing a basic operation of the elevator control device in the first embodiment according to the present invention.

FIG. 5 is a flowchart showing a basic operation of the elevator control device in the first embodiment according to the present invention.

When a person intending to pass through the security gate 2 performs a predetermined operation to the person authentication device 3, the person authentication device 3 operates to judge whether or not the verified person is the registered person (authentication result is OK or NG) (S101, S102). If the verified person is authenticated as the registered person in S102, the security gate 2 is opened, so that the verified person can move into the elevator hall (S103). At the same time, if it is authenticated in S102 that the verified person is the registered person, the indication device 4 displays the destination floor of the verified person (S104).

The verification control device 5 extracts the destination floor information of the verified person authenticated in S102, and transmits it to the group control cabinet 1 (S105). By receiving the destination floor information from the verification control device 5, the group control cabinet 1 automatically registers the hall call, and selects the assigned car for the destination floor information (S106, S107). When the assigned car for the verified person is determined in S107, that information is transmitted to the security gate 2, and the indication device 4 displays the information on the assigned car (S108, S109).

Subsequently, when the assigned car arrives at the entrance floor and the door opening operation is performed, the state in which the verified person can ride on the car is established (S110). After the door has been opened in S110, when the ride on the assigned car is detected, the car call of the destination floor of the verified person is automatically registered, and the assigned car begins to run to the destination floor (S110).

If the verified person is not authenticated as the registered person in S102, the security gate 2 does not open, and the verified person is not permitted to move into the elevator hall (S112).

Figure 6:
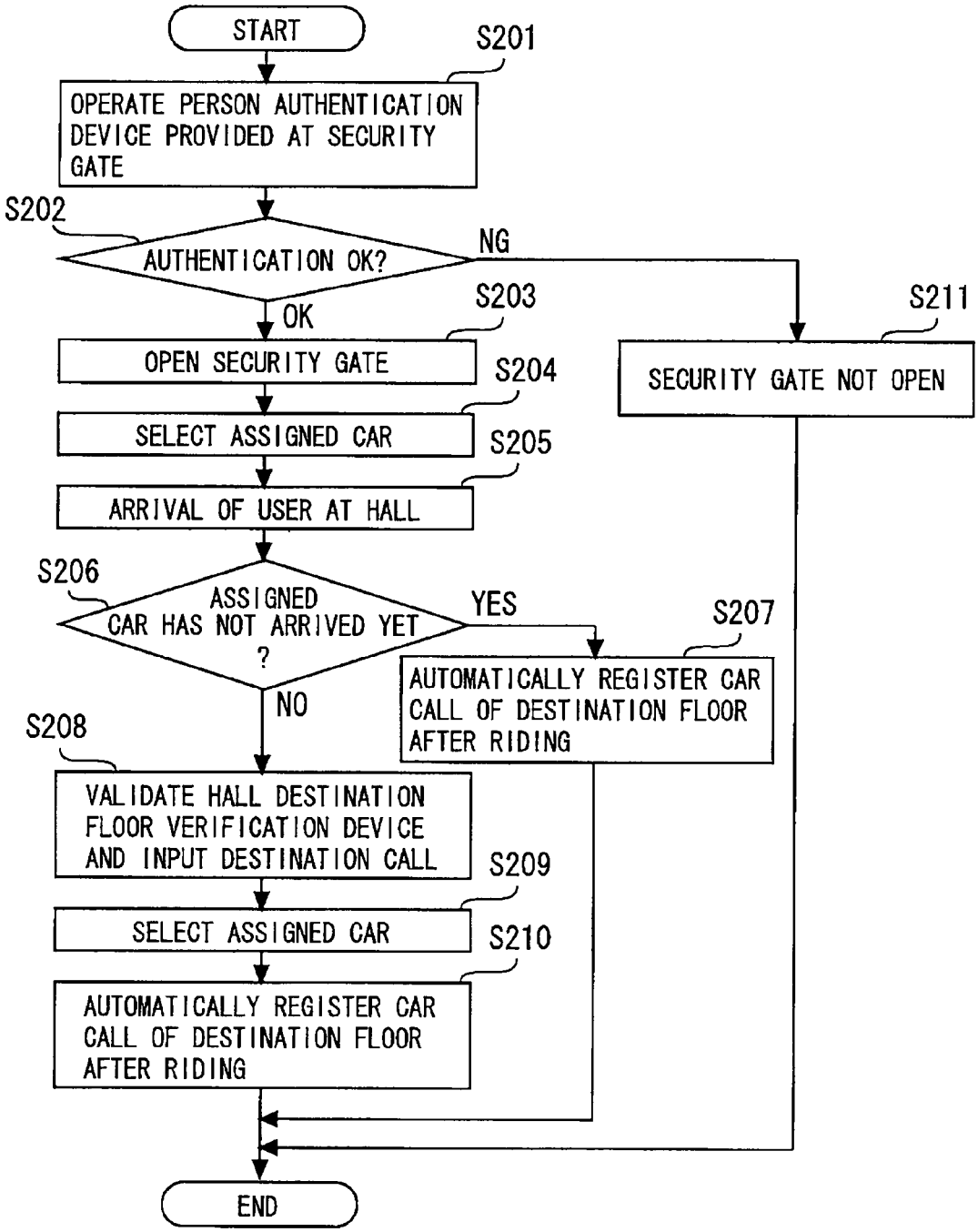
FIG. 6 is a flowchart showing a characteristic operation of the elevator control device in the first embodiment according to the present invention.

FIG. 6 is a flowchart showing a characteristic operation of the elevator control device in the first embodiment according to the present invention. FIG. 6 shows the operation in the case where the verified person having been authenticated as the registered person by the person authentication device 3 cannot ride on his/her assigned car.

When a person intending to pass through the security gate 2 performs a predetermined operation to the person authentication device 3, the person authentication device 3 operates to judge whether or not the verified person is the registered person (authentication result is OK or NG) (S201, S202). If the verified person is authenticated as the registered person in S202, the same operations as those in S104 to S107 are performed, and the assigned car is selected for the verified person (S203, S204).

When the user (the verified person) arrives at the hall (specifically, the hall for the assigned car) to ride on the assigned car (S205), the group control cabinet 1 judges whether or not the assigned car has arrived at that hall (S206). If the assigned car does not yet arrive, so that the user is at the hall before the elevator, after the ride of the user on the assigned car at the hall has been detected, the car call of destination floor is automatically registered (S207). That is, the operations from S206 to S207 show the case where the verified person can ride on the assigned car without having missed the car.

On the other hand, if it is detected that the assigned car has arrived at the hall before the verified person arrives at the hall (No in S206), the registration control means 25 makes the destination floor registration made using the hall destination floor registration device 20 in a valid state. Therefore, the verified person later arriving at the hall can input his/her destination floor by operating the hall destination floor registration device 20 (S208). In this case, the group control cabinet 1 selects the assigned car based on the destination floor information transmitted from the hall destination floor registration device 20 (S209). Thereafter, when the ride on the assigned car at the floor on which the hall destination floor registration device 20 is provided is detected, the car call based on the destination floor information is automatically registered, and the assigned car begins to run to the destination floor (S210).

If the verified person is not authenticated as the registered person in S202, the security gate 2 does not open, and the verified person is not permitted to move into the elevator hall (S211).

In the operation shown in FIG. 6, the fact that "the assigned car for the verified person has arrived at the hall before the verified person authenticated as the registered person by the person authentication device 3 arrives at the hall" is adopted as the predetermined condition that the registration control means 25 validates the destination floor registration made using the hall destination floor registration device 20. Due to the adoption of this predetermined condition, even when the user arrives at the hall late for some reason and misses his/her assigned car, the user can register his/her destination floor in the hall.

The above is merely an explanation of one example, and any other condition may be adopted as the predetermined condition that the registration control means 25 validates the destination floor registration made using the hall destination floor registration device 20. For example, the destination floor registration made using the hall destination floor registration device 20 is always invalidated, and in the case where the assigned car is full-load at the hall, or in the case where the assignment to the verified person is cancelled for some reason before the assigned car arrives at the hall, the destination floor registration made using the hall destination floor registration device 20 may be validated. By the adoption of such a condition, problems of full-load and occurrence of failure can be overcome.

Also, the configuration may be made such that no restrictive condition is adopted, and the destination floor registration made using the hall destination floor registration device 20 is always validated.

Figure 7:
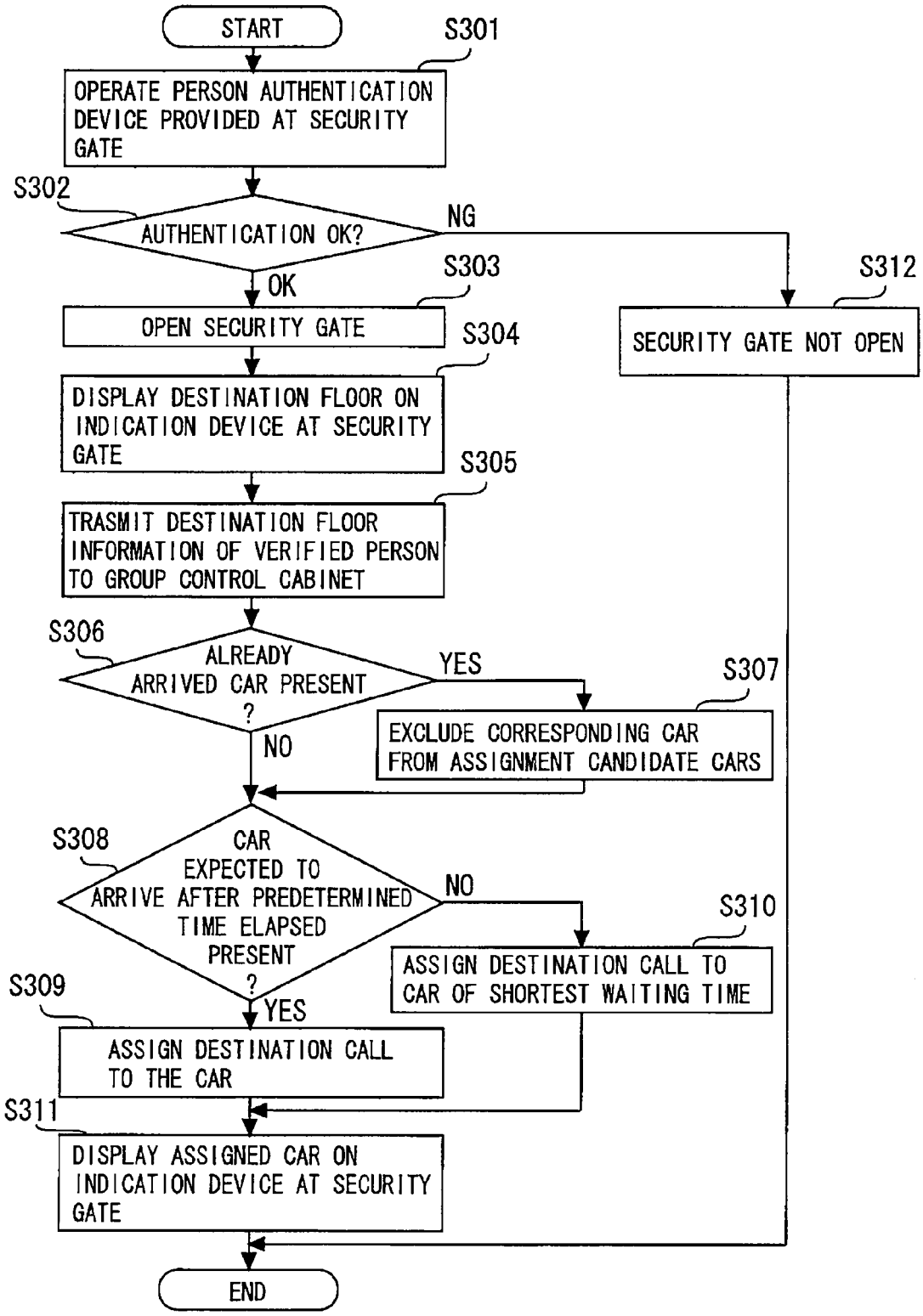
FIG. 7 is a flowchart showing another characteristic operation of the elevator control device in the first embodiment according to the present invention.

FIG. 7 is a flowchart showing another characteristic operation of the elevator control device in the first embodiment according to the present invention. The operations in S301 to S305 and S312 shown in FIG. 7 are the same as those in S101 to S105 and S112 shown in FIG. 5, and therefore the explanation thereof is omitted.

When the destination floor information of the verified person is transmitted from the verification control device 5, the group control cabinet 1 selects the optimum assigned car considering the moving distance or moving time required from when the verified person is authenticated by the person authentication device 3 to when he/she arrives at the hall. Specifically, first, the group control cabinet 1 judges whether or not a car having already arrived at the hall is present (S306), and excludes the corresponding car from the assignment candidate cars (S307). Next, the group control cabinet 1 judges whether or not a car expected to arrive at the hall after predetermined time has elapsed is present (S308), and, if the corresponding car is present, the group control cabinet 1 selects that car as the assigned car (S309). If the corresponding car is not present in S308, the group control cabinet 1 selects the car such that the waiting time of the verified person in the hall is the shortest as the assigned car (S310). The reason for this is that wasteful operation caused by missing and previous call assignment is prevented as far as possible considering the time for moving from the security gate 2 to the hall.

When the assigned car for the verified person is determined, this information is transmitted to the security gate 2, and the information on the assigned car is displayed on the indication device 4 (S311). Subsequently, the same operation as that shown in FIG. 5 or 6 is performed.

According to the first embodiment of the present invention, even in the case where the user could not ride on the assigned car for some reason after passing through the building security gate 2, the use of elevator by the user is enabled, and the decrease in convenience can be prevented.

That is, even in the case where the elevator user could not ride on the assigned car due to missing or the like after passing through the security gate 2, the user can use the elevator immediately by operating the hall destination floor registration device 20.

Also, according to the above-described configuration, the optimum operation control considering the distance from the security gate 2 to the elevator hall and the moving time of user can be realized. Therefore, the operation efficiency of the whole of elevator can be improved, and comfortable service can be offered.

In the first embodiment, explanation has been given of the case where the group control cabinet 1 carries out the control of a single bank. However, the elevator controlled by the group control cabinet 1 may consist of a plurality of banks. Even in this case, the above-described effects can be achieved by the same configuration as described above. Also, concerning the application of building, the elevator control device can be applied to not only an office building but also a large apartment building, a hotel, and the like.

Industrial Applicability

As described above, the elevator control device according to the present invention can be applied to the case where a security gate is provided in a building, and the control of elevator is interlocked with the security gate.

The invention claimed is:

1. An elevator control device comprising:

a group control cabinet for controlling a plurality of elevators provided in a building as one group;

a security gate provided on a passage leading to a hall of the one group of elevators; and a first person authentication device provided at the security gate, wherein when a verified person is authenticated as a registered person by the first person authentication device, the security gate is opened to allow the verified person to move into the hall;

a destination call assignment device provided in the group control cabinet to determine an assigned car for the verified person, who has been authenticated, based on the previously registered destination floor information when the verified person is authenticated as the registered person by the person authentication device;

a destination call automatic registration device which automatically registers a destination call based on the previously registered destination floor information for the assigned car when it is detected that a user has boarded the assigned car, which is determined by the destination call assignment device, at a predetermined floor;

a hall destination floor registration device provided in the hall so that the user who is present in the hall registers his/her destination floor; and a registration controller which allows the destination floor registration of the user made using the hall destination floor registration device to be valid based on a predetermined condition and that the user has not boarded the assigned car.

2. The elevator control device according to claim 1, wherein the registration controller validates the destination floor registration of the user made using the hall destination floor registration device in at least one case of a case that the assigned car for the verified person has arrived at the hall before the verified person authenticated as the registered person by the person authentication device arrives at the hall, a case that the assigned car is at a full-load at the hall, and a case that the assignment to the verified person is cancelled before the assigned car arrives at the hall.

3. The elevator control device according to claim 1, wherein a second person authentication device of a same type as that of the first person authentication device provided at the security gate is installed in the elevator hall; and the registration controller validates the destination floor registration of the user made using the hall destination floor registration device in a case that the verified person is authenticated as the registered person by the second person authentication device installed in the elevator hall.

4. The elevator control device according to claim 1, wherein the destination call assignment device determines the assigned car for the verified person, who has been verified as the registered person by the person authentication device, based on the previously registered destination floor information and the moving distance or moving time required from when the user is authenticated by the person authentication device to when he/she arrives at the elevator hall.

* * * * *